US011284773B2

(12) United States Patent
AlHaffar et al.

(10) Patent No.: US 11,284,773 B2
(45) Date of Patent: Mar. 29, 2022

(54) SYSTEM AND METHOD FOR CONTROLLING THE WATER FILL LEVEL WITHIN A DISHWASHER APPLIANCE

(71) Applicant: Haier US Appliance Solutions, Inc., Wilmington, DE (US)

(72) Inventors: Nasib AlHaffar, Louisville, KY (US); Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 17 days.

(21) Appl. No.: 16/778,145

(22) Filed: Jan. 31, 2020

(65) Prior Publication Data

US 2021/0235964 A1 Aug. 5, 2021

(51) Int. Cl.
*A47L 15/42* (2006.01)
*A47L 15/00* (2006.01)

(52) U.S. Cl.
CPC ..... *A47L 15/4244* (2013.01); *A47L 15/0023* (2013.01); *A47L 15/4217* (2013.01)

(58) Field of Classification Search
CPC ..... A47L 15/00–15/508; F04D 9/00–9/065
See application file for complete search history.

(56) References Cited

U.S. PATENT DOCUMENTS 4,178,957 A * 12/1979 Hoffman ..... A47L 15/4244 134/57 D
5,313,964 A * 5/1994 Dausch ..... A47L 15/4244 134/57 D
5,409,023 A * 4/1995 Santarossa ..... A47L 15/0023 134/56 D
5,525,161 A * 6/1996 Milocco ..... A47L 15/0047 134/18
5,797,996 A * 8/1998 Milocco ..... A47L 15/0023 134/18
8,845,814 B2 9/2014 Pers et al.
2007/0172360 A1* 7/2007 Teipen ..... F04D 15/0236 417/36

(Continued)

FOREIGN PATENT DOCUMENTS

EP 0080948 B1 6/1983
EP 0118719 B1 8/1986

OTHER PUBLICATIONS

Mouser Electronics, Pressure Sensors Absolute, Differential, Gage, Vacuum Gage/Amplified, Honeywell https://www.mouser.com/datasheet/2/187/hwscs05670_1-2270588.pdf (Year: 2021).*

*Primary Examiner* — Michael E Barr
*Assistant Examiner* — Omair Chaudhri
(74) *Attorney, Agent, or Firm* — Dority & Manning, P.A.

(57) ABSTRACT

A dishwasher appliance includes a sump, a water supply valve for providing a flow of water into the sump, and a circulation pump that circulates water that is collected in the sump to one or more spray arm assemblies. A pressure sensor is operably coupled to the sump for monitoring sump pressure and wash fluid level. A controller regulates the water supply valve to provide the flow of water into the sump and monitors the sump pressure during the fill process. The controller further determines that the circulation pump is primed when the rate of increase of the sump pressure exceeds the predetermined threshold rate and stops further filling of the sump.

20 Claims, 6 Drawing Sheets

(56) References Cited

U.S. PATENT DOCUMENTS

| | | | | |
|---|---|---|---|---|
| 2012/0312325 | A1* | 12/2012 | Gnadinger | A47L 15/0049 134/18 |
| 2013/0008477 | A1* | 1/2013 | Forst | A47L 15/421 134/57 D |
| 2014/0158163 | A1 | 6/2014 | Montgomery et al. | |
| 2014/0360530 | A1* | 12/2014 | Pers | A47L 15/0049 134/18 |
| 2019/0179350 | A1 | 6/2019 | Durham | |

* cited by examiner

SYSTEM AND METHOD FOR CONTROLLING THE WATER FILL LEVEL WITHIN A DISHWASHER APPLIANCE

FIELD OF THE INVENTION

The present disclosure relates generally to dishwasher appliances, and more particularly to the use of water level detection systems to optimize fill levels within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a circulation pump may be used to circulate wash fluid to spray assemblies within the wash chamber that can apply or direct wash fluid towards articles disposed within the rack assemblies in order to clean such articles. During a drain cycle, a drain pump may periodically discharge soiled wash fluid that collects in the sump space and the process may be repeated.

In general, it is considered desirable for a dishwasher appliance to operate quietly. The noise level generated by the circulation pump is critical to such quiet operation. However, an undesirably high noise level may be generated if air is drawn into the circulation pump and becomes entrained in the circulated liquid, e.g., when a water level in the sump is insufficient to prime the pump. To avoid this operating condition, conventional dishwasher appliances utilize fill algorithms that commonly overfill the sump beyond a prime level. However, it is also considered desirable for a dishwasher appliance to operate efficiently, for example, by using the least amount of water necessary to prime the circulation pump.

Accordingly, a dishwasher appliance having improved features for determining the water level in the sump would be desirable. More specifically, a dishwasher appliance including features and methods for filling the sump with an optimal amount of water would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance is provided including a sump for collecting water, a circulation pump in fluid communication with the sump for circulating the water to one or more spray arm assemblies, and a water supply valve for selectively providing a flow of water into the sump. A pressure sensor is operably coupled to the sump and a controller is communicatively coupled with the pressure sensor and the circulation pump. The controller is configured for regulating the water supply valve to provide the flow of water into the sump, monitoring a sump pressure using the pressure sensor, determining that the circulation pump is primed if a rate of increase of the sump pressure exceeds a predetermined threshold rate.

In a second example embodiment, a method for determining that a circulation pump of a dishwasher appliance is primed is provided. The dishwasher appliance includes a sump for collecting water, a water supply valve for selectively providing a flow of water into the sump, and a pressure sensor operably coupled to the sump. The method includes regulating the water supply valve to provide the flow of water into the sump, monitoring a sump pressure using the pressure sensor, and determining that the circulation pump is primed if a rate of increase of the sump pressure exceeds a predetermined threshold rate.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
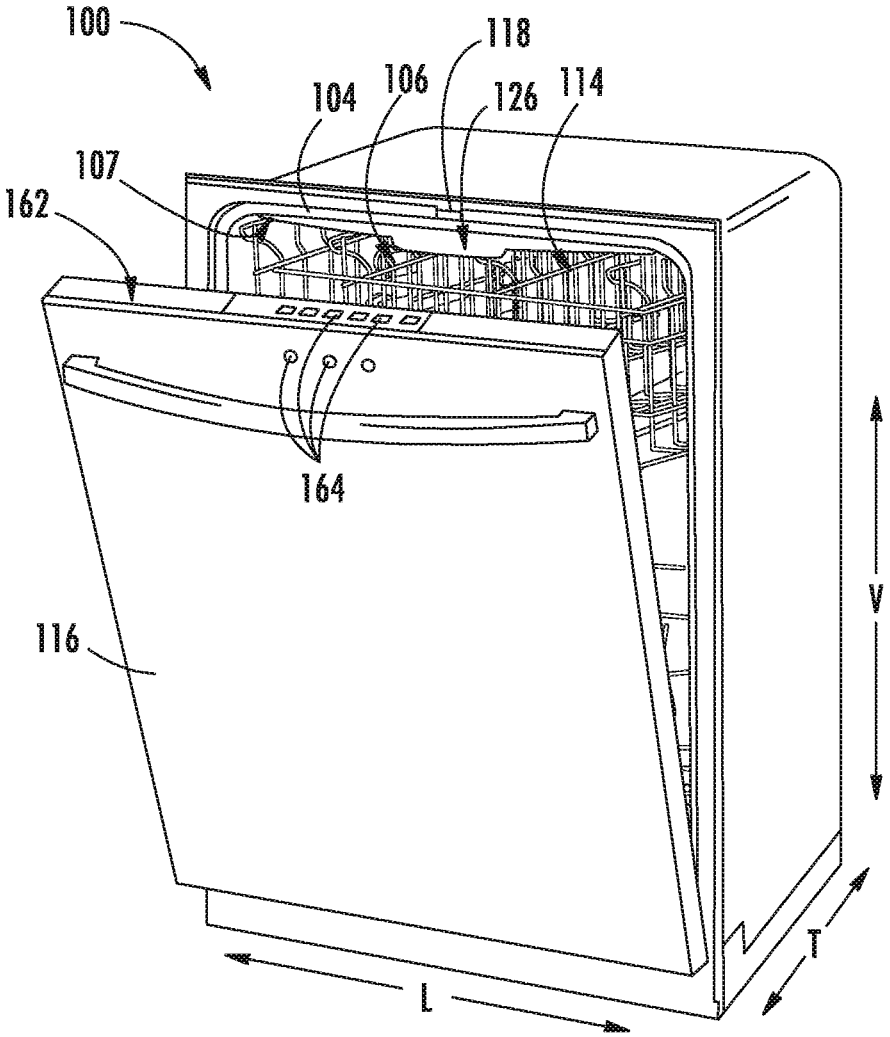
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
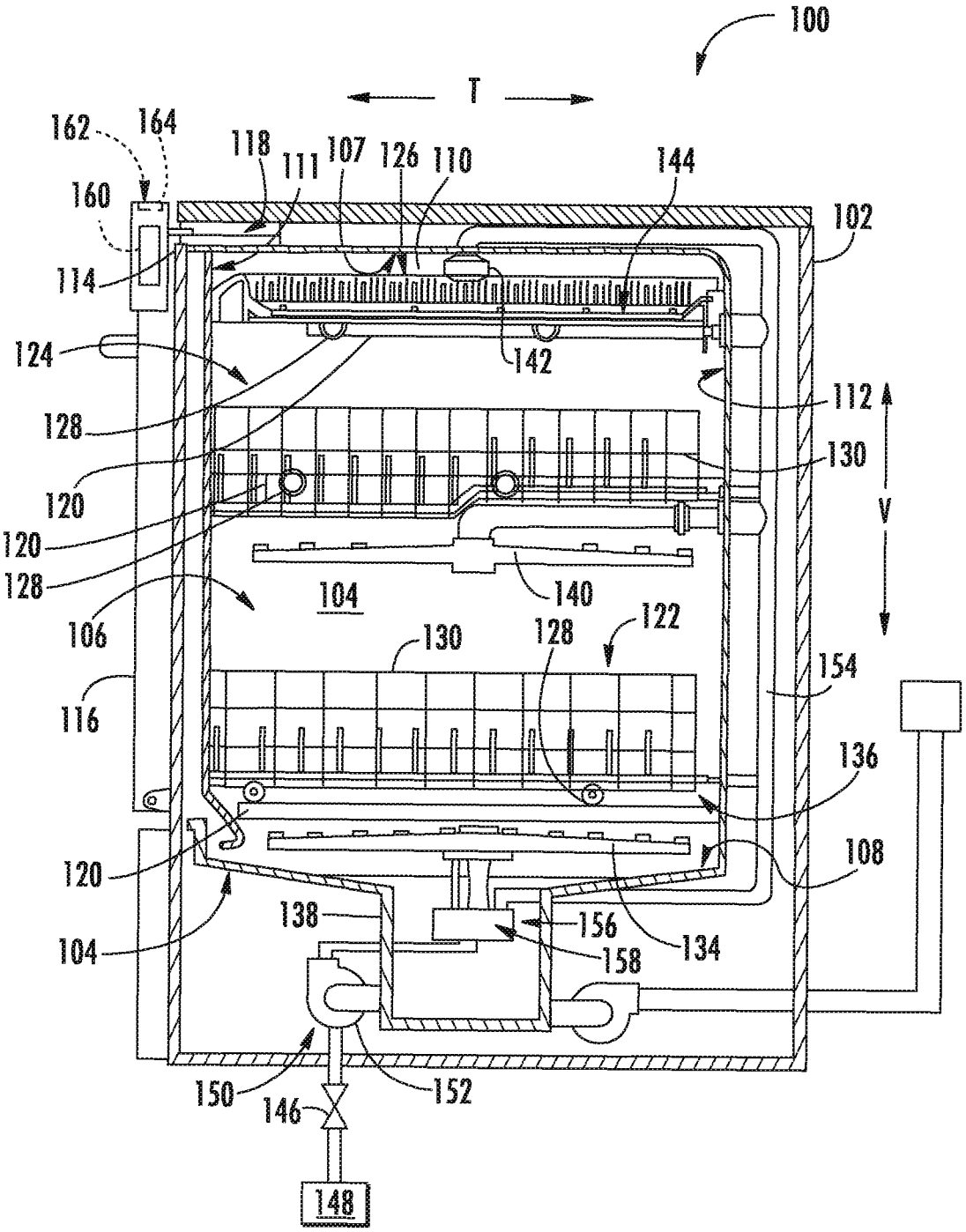
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

Dishwasher 100 may further include a water supply valve 146 positioned between an external water supply 148 and a circulation pump (such as pump 152 described below) to selectively allow water to flow from the external water supply 148 into circulation pump 152. Additionally or alternatively, water supply valve 146 can be positioned between the external water supply 148 and sump 138 to selectively allow water to flow from the external water supply 148 into sump 138. Water supply valve 146 can be selectively controlled to open and allow the flow of water into dishwasher 100 and can be selectively controlled to cease the flow of water into dishwasher 100.

The various spray assemblies, manifolds, and water supplies described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds, e.g., during wash and/or rinse cycles. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein.

For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
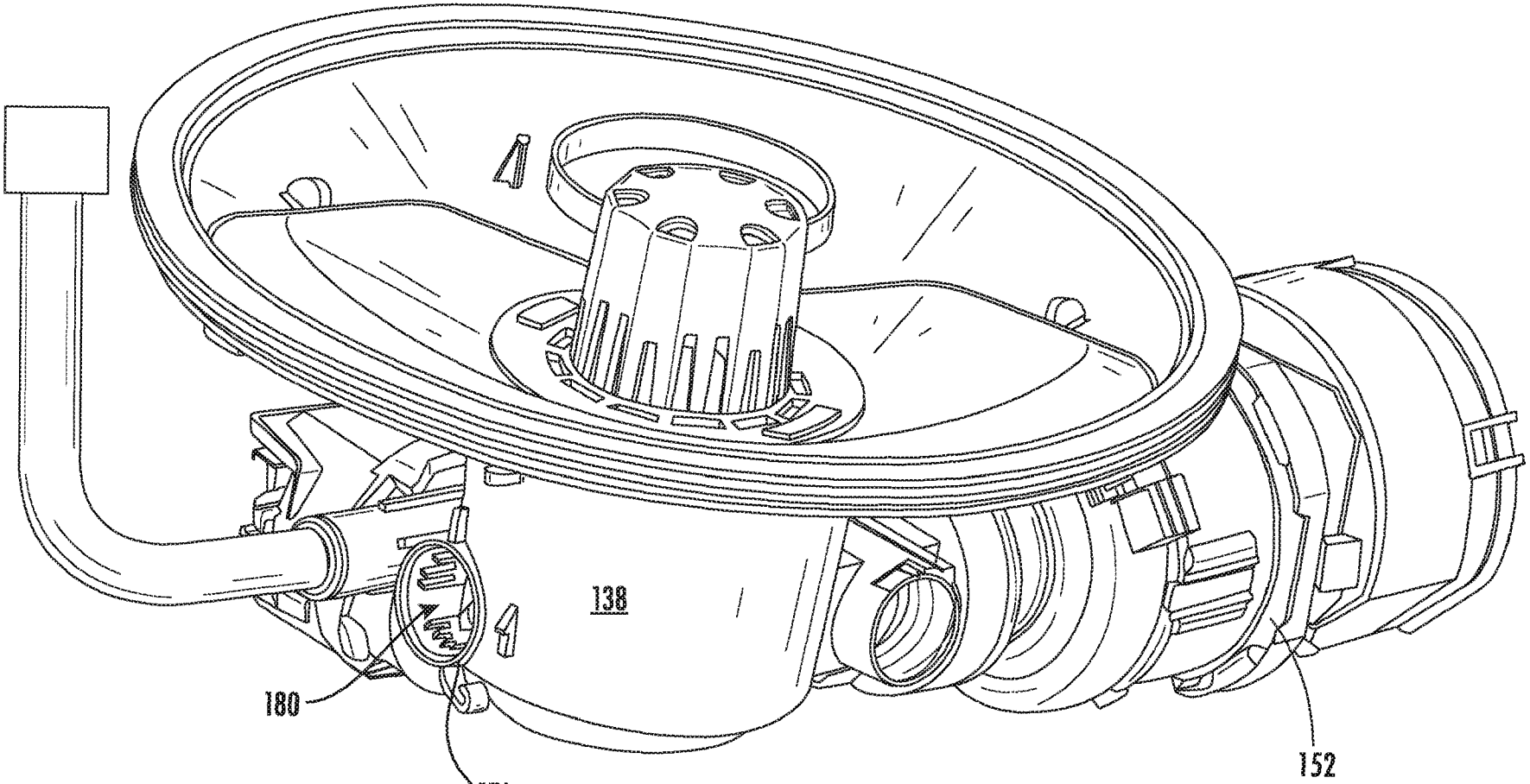
FIG. 3 provides a perspective view of a sump assembly of the exemplary dishwashing appliance of FIG. 1 according to an example embodiment of the present subject matter.
Figure 4:
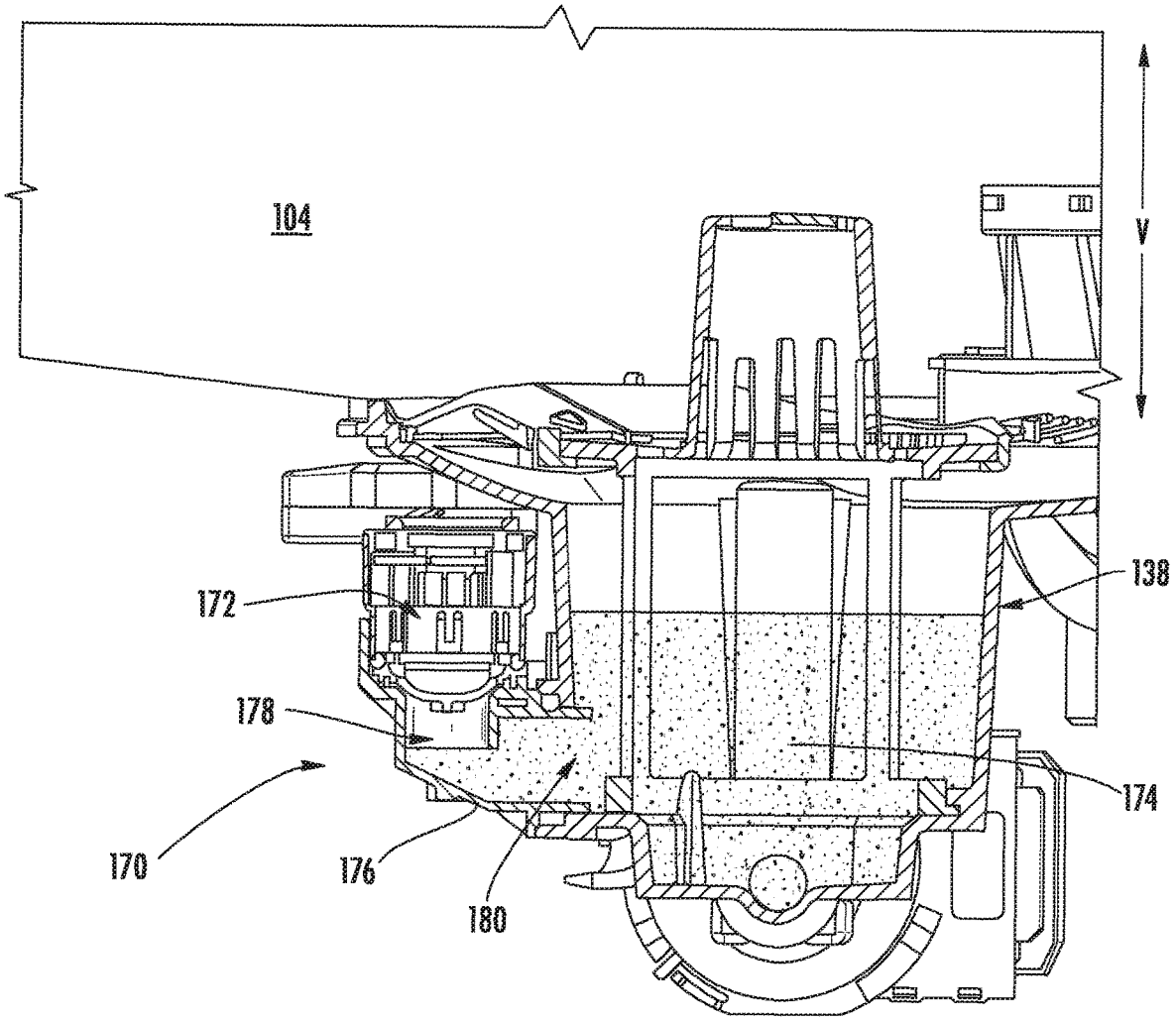
FIG. 4 provides a cross sectional view of the exemplary sump assembly of FIG. 3.

Referring now generally to FIGS. 3 and 4, a water level detection system 170 according to an exemplary embodiment of the present subject matter will be described. Water level detection system 170 may generally be configured for continuously or periodically measuring a level of water or wash fluid within dishwasher 100. Water level detection system 170 described herein is only one exemplary configuration used for the purpose of explaining aspects of the present subject matter and is not intended to limit the scope of the invention in any manner.

As illustrated, a water level detection system 170 includes a pressure sensor 172 operably coupled to sump 138 for measuring a pressure of wash fluid 174 (see FIG. 4) within sump 138 to facilitate wash fluid level detection. According to the illustrated embodiment, pressure sensor 172 is mounted to a receiving boss 176 defined by sump 138. More specifically, receiving boss 176 may further define an air chamber 178 that provides a vertical gap between pressure sensor 172 and the level of wash fluid 174 within receiving boss 176, e.g., to prevent contamination or fouling of pressure sensor 172.

In general, pressure sensor 172 may be any sensor suitable for determining a water level within sump 138 based on pressure readings. For example, pressure sensor 172 may be a piezoelectric pressure sensor and thus may include an elastically deformable plate and a piezoresistor mounted on the elastically deformable plate. However, it should be appreciated that according to alternative embodiments, pressure sensor 172 may be any type of pressure sensor that is fluidly coupled to sump 138 in any other suitable manner for obtaining sump pressures to facilitate water level detection.

Water level detection system 170 and pressure sensor 172 generally operate by measuring a pressure of air within air chamber 178 and using the measured chamber pressure to estimate the water level in sump 138. For example, when the water level within sump 138 falls below a chamber inlet 180, the pressure within air chamber 180 normalizes to ambient or atmospheric pressure, and thus reads a zero pressure. However, when water is present in sump 138 and rises above chamber inlet 180, the measured air pressure becomes positive and may increase proportionally with the water level. Although sump 138 is described herein as containing water, it should be appreciated that aspects of the present subject matter may be used for detecting the level of any other suitable wash fluid or liquid in any other appliance.

Now that the construction of dishwasher appliance 100 and the configuration of controller 160 according to exemplary embodiments have been presented, an exemplary method 200 of operating a dishwasher appliance will be described. Although the discussion below refers to the exemplary method 200 of operating dishwasher appliance 100, one skilled in the art will appreciate that the exemplary method 200 is applicable to the operation of a variety of other dishwasher appliances or other suitable appliances. In exemplary embodiments, the various method steps as disclosed herein may be performed by controller 160 or a separate, dedicated controller.

Figure 5:
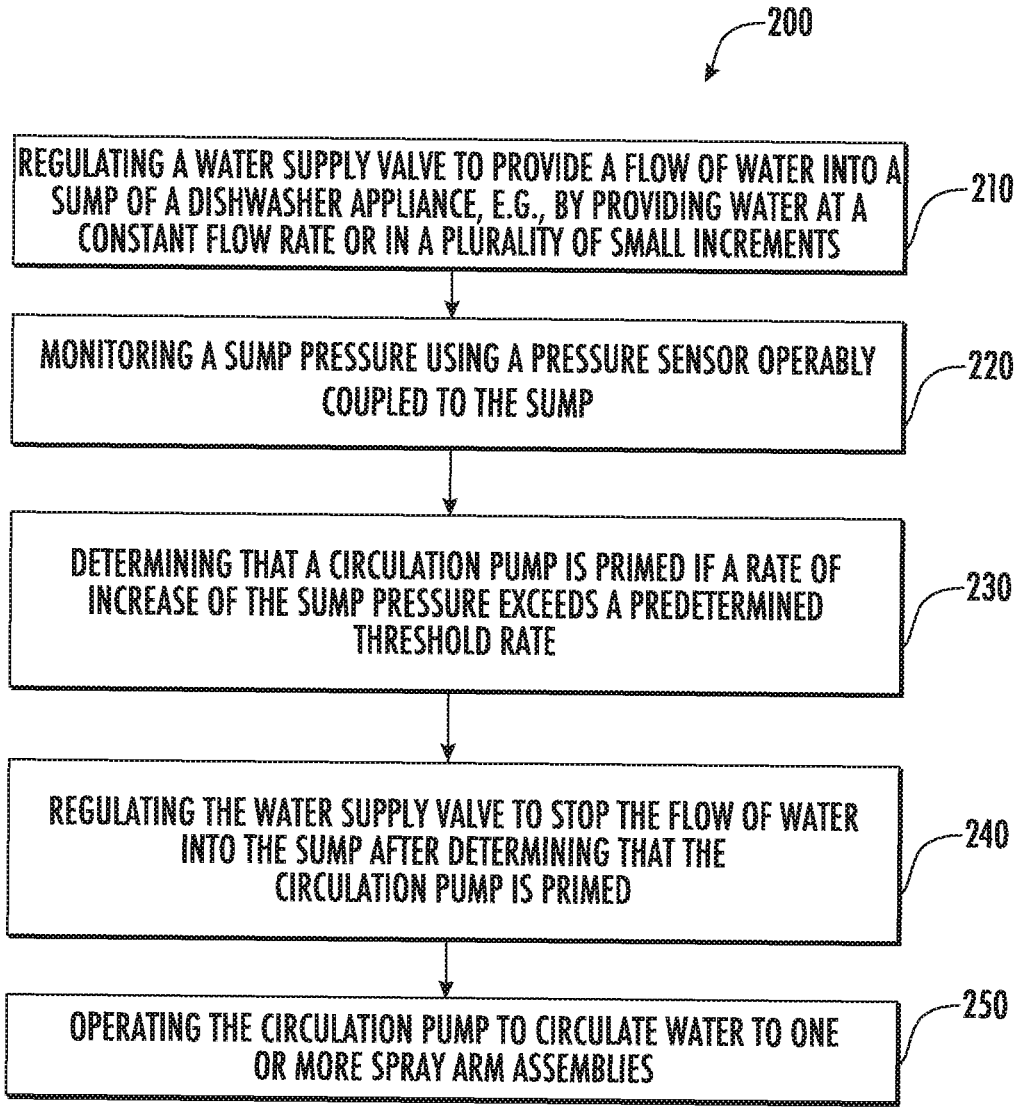
FIG. 5 provides a method of using a water level detection system to efficiently fill the sump of the exemplary dishwasher appliance of FIG. 1 according to an exemplary embodiment.

Referring now to FIG. 5, method 200 includes, at step 210, regulating a water supply valve to provide a flow of water into a sump of a dishwasher appliance. In this regard, continuing the example from above, at the start of a wash or rinse cycle water supply valve 146 may be opened to permit a flow of water from water supply 148 into pump 152 or directly into sump 138. Step 220 includes monitoring a sump pressure using a pressure sensor operably coupled to sump. In this regard, pressure sensor 172 of water level detection system 170 may be used to periodically or continuously monitor sump pressures to facilitate water level detection. For example, FIGS. 6 and 7 illustrate sump pressure curves showing the sump pressure over time during exemplary fill processes, as described in more detail below.

According to exemplary embodiments, water supply valve 146 may remain open and provide a flow of water at a relatively constant flow rate to fill sump 138 to a desired fill level. As explained above, the desired fill level may typically correspond to the fill level required to prime the pump 152, e.g., such that pump 152 may operate without cavitation or other noisy operation. As explained herein, aspects of the present subject matter are directed to methods of efficiently filling dishwasher appliance 100 with water or wash fluid 174 such that pump prime is achieved while overfilling is avoided.

According to exemplary embodiments, controller 160 may regulate water supply valve 146 to provide the flow of water into sump 138 in any particular manner. For example, according to one exemplary embodiment, water supply valve 146 may be opened to provide the flow of water at a constant flow rate. In addition, or alternatively, the constant flow rate of water may be maintained until the level of wash fluid in sump 138 reaches a predetermined prefill amount. In this regard, the prefill amount may be below the prime level such that water may be quickly added without concern of overfilling. Water supply valve 146 may then be regulated to provide the flow of water in a plurality of incremental steps until prime level is reached. For example, the incremental steps may permit sump pressure measurements after each microfill to accurately identify when the prime level is reached and avoid overfilling sump 138.

Figure 6:
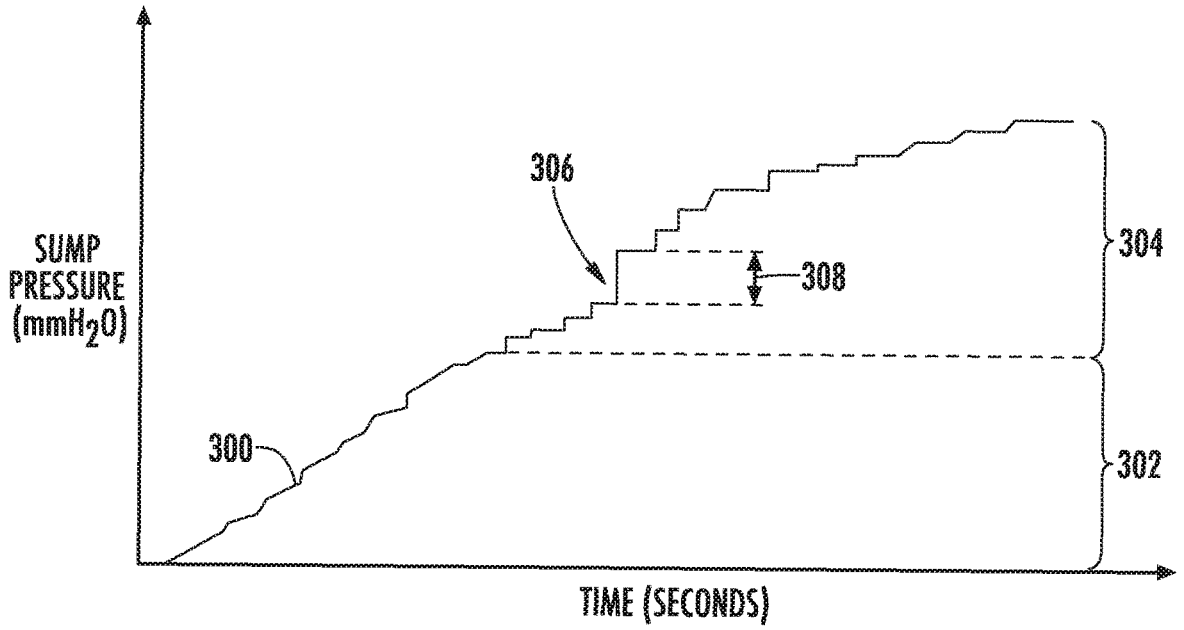
FIG. 6 is a plot of a sump pressure curve of the measured sump pressure over time during a fill cycle according to an exemplary embodiment of the present subject matter.
Figure 7:
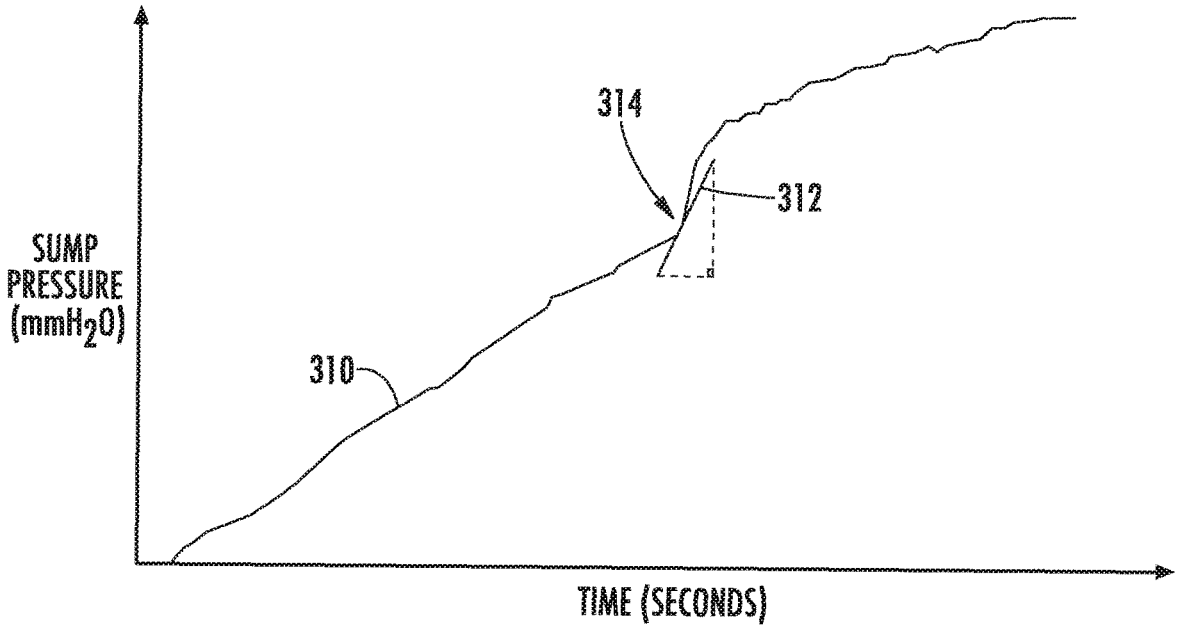
FIG. 7 is a plot of a sump pressure curve of the measured sump pressure over time during a fill cycle according to an exemplary embodiment of the present subject matter.

Referring briefly to FIGS. 6 and 7, sump pressure curves are illustrated for two different fill cycles of dishwasher appliance 100. Specifically, FIG. 6 illustrates a sump pressure curve 300 including a two-stage fill process that includes both a prefill stage 302 at a constant flow rate and a subsequent microfill stage 304 involving a plurality of incremental fills, referred to herein generally have "microfills." In general, prefill stage 302 is designed to fill sump 138 to a level that is below the prime level and the subsequent microfill stage 304 is designed to carefully approach the prime level using a series of pauses to avoid overfilling sump 138. For example, according to an exemplary embodiment, water supply valve 146 may be regulated during the prefill stage 302 to provide a flow of water for a predetermined time period or until a predetermined sump pressure or water level is reached. According to an exemplary embodiment, water supply valve 146 may be regulated during the microfill stage 304 to provide an incremental volume, such as 0.1 gallons every second or may provide any suitable incremental fill volume at any desirable frequency of time.

By contrast, FIG. 7 illustrates a sump pressure curve 310 for a fill process where water supply valve 146 is opened and maintained at a relatively constant flow rate for the entire fill process. According to such an embodiment, controller 160 may continuously monitor sump pressure to facilitate an efficient fill process as described below. Specifically, as described herein, these sump pressure curves may be used to determine an efficient fill level where pump 152 is primed without overfilling sump 138. It should further be appreciated that the fill processes described herein are only exemplary and are not intended to limit the scope of the present subject matter.

Step 230 includes determining that a circulation pump is primed if a rate of increase of the sump pressure exceeds a predetermined threshold rate. In this regard, without being bound by any particular theory, it is apparent that there is a detectable increase in the slope of the sump pressure curve when the water level sufficient to prime pump 152 is reached (referred to herein generally as the "prime level"). By detecting this rate increase, controller 160 may accurately fill to the prime level without overfilling sump 138. Thus, step 240 may include regulating the water supply to stop the flow of water into the sump after determining that the circulation pump is primed. In addition, step 250 may include operating a circulation pump to circulate water to one or more spray arm assemblies, e.g., to perform a wash or rinse cycle, after the prime fill level is reached. According to exemplary embodiments, this prime level detection algorithm may be implemented prior to operating pump 152 during every wash cycle or rinse cycle. Alternatively, this process may be used periodically to provide controller 160 with data sufficient to accurately predict fill levels and compensate for fill variations, such as variations in water valve performance, water supply pressures, etc.

Notably, step 230 of determining that a circulation pump is primed may utilize any detectable variation in the sump pressure curve which may be indicative of the wash fluid reaching prime level. For example, controller 160 may obtain a first pressure reading and a second pressure reading a predetermined amount of time after the first pressure reading. Controller 160 may then determine that the prime level has been reached (e.g., as indicated at point 306 in FIG. 6) if a difference between the first pressure reading and the second pressure reading (indicated by reference numeral 308 in FIG. 6) exceeds a predetermined pressure difference.

In this regard, based on the expected increase in pressure for a given microfill volume and a known measurement frequency, controller 160 may know the wash fluid level based on the pressure difference of sequential pressure readings. For example, continuing example above where 0.1 gallons of water are added every one second, a pressure difference between sequential measurements of greater than 4 mm of water may indicate that prime level has been reached. It should be appreciated that the incremental fill amounts, the incremental fill frequency, and the anticipated pressure difference at prime level may vary while remaining within the scope of the present subject matter.

According to alternative embodiments such as shown in FIG. 7, controller 160 may monitor sump pressure and generate a sump pressure curve 310. In addition, controller 160 may implement any suitable mathematical method for determining a slope of the sump pressure curve 310 (such as taking a derivative of the sump pressure curve 310). According to such an embodiment, step 230 of determining that a circulation pump is primed may include determining that the slope of the sump pressure curve 310 exceeds a predetermined slope.

In this regard, referring for example to FIG. 7, the rate of change of the sump pressure or the sump pressure slope (e.g. as indicated by reference numeral 312) exceeds a predetermined slope threshold at prime level 314. Thus, by continuously monitoring the slope of the sump pressure curve, and by knowing a slope threshold corresponding to the water level within sump 138 reaching prime level, controller 160 may accurately predict when prime level 314 has been reached. In this manner, an efficient fill volume may be achieved using only a sump pressure sensor without other complex and costly sensors or detection systems.

FIG. 5 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dishwasher appliance 100 as an example, it should be appreciated that these methods may be applied to the operation of any suitable dishwasher, washing machine appliance, or other appliance where efficient fill levels are desirable.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance, comprising:

a sump for collecting water;

a circulation pump in fluid communication with the sump for circulating the water to one or more spray arm assemblies;

a water supply valve for selectively providing a flow of water into the sump;

a pressure sensor operably coupled to the sump; and a controller communicatively coupled with the pressure sensor and the circulation pump, the controller configured for:

regulating the water supply valve to provide the flow of water into the sump;

monitoring a sump pressure using the pressure sensor while the circulation pump is not operating; and determining that the circulation pump is primed if a rate of increase of the sump pressure exceeds a predetermined threshold rate.

2. The dishwasher appliance of claim 1, wherein regulating the water supply valve to provide the flow of water into the sump comprises:

opening the water supply valve to provide the flow of water at a constant flowrate.

3. The dishwasher appliance of claim 2, wherein regulating the water supply valve to provide the flow of water into the sump further comprises the controller performing the following steps:

determining that the water in the sump has reached a prefill amount; and selectively opening the water supply valve to provide the flow of water in a plurality of incremental steps.

4. The dishwasher appliance of claim 3, wherein selectively opening the water supply valve to provide the flow of water in a plurality of incremental steps comprises:

supplying the flow of water in increments of less than 0.1 gallons every second.

5. The dishwasher appliance of claim 3, determining that the water in the sump has reached the prefill amount comprises:

opening the water supply valve for a predetermined fill time less than that required to prime the circulation pump.

6. The dishwasher appliance of claim 1, wherein determining that the rate of increase of the sump pressure exceeds the predetermined threshold rate comprises:

obtaining a first pressure reading;

obtaining a second pressure reading a predetermined amount of time after the first pressure reading; and determining that a difference between the first pressure reading and the second pressure reading exceeds a predetermined pressure difference.

7. The dishwasher appliance of claim 6, wherein the predetermined pressure difference is greater than 4 millimeters of water.

8. The dishwasher appliance of claim 1, wherein determining that the rate of increase of the sump pressure exceeds the predetermined threshold rate comprises the controller performing the following steps:

generating a sump pressure curve of the sump pressure over time;

determining a slope of the sump pressure curve; and determining that the slope of the sump pressure curve exceeds a predetermined slope.

9. The dishwasher appliance of claim 1, wherein the controller is further configured to:

regulating the water supply valve to stop the flow of water into the sump after determining that the circulation pump is primed; and operating the circulation pump to circulate water to the one or more spray arm assemblies.

10. The dishwasher appliance of claim 1, wherein the controller is configured for determining that the circulation pump is primed before operating the circulation pump during every wash cycle or rinse cycle.

11. A method for determining that a circulation pump of a dishwasher appliance is primed, the dishwasher appliance comprising a sump for collecting water, a water supply valve for selectively providing a flow of water into the sump, and a pressure sensor operably coupled to the sump, the method comprising:

regulating the water supply valve to provide the flow of water into the sump;

monitoring a sump pressure using the pressure sensor while the circulation pump is not operating; and determining that the circulation pump is primed if a rate of increase of the sump pressure exceeds a predetermined threshold rate.

12. The method of claim 11, wherein regulating the water supply valve to provide the flow of water into the sump comprises:

opening the water supply valve to provide the flow of water at a constant flowrate.

13. The method of claim 12, wherein regulating the water supply valve to provide the flow of water into the sump further comprises:

determining that the water in the sump has reached a prefill amount; and selectively opening the water supply valve to provide the flow of water in a plurality of incremental steps.

14. The method of claim 13, wherein selectively opening the water supply valve to provide the flow of water in a plurality of incremental steps comprises:

supplying the flow of water in increments of less than an incremental volume every second.

15. The method of claim 13, determining that the water in the sump has reached the prefill amount comprises:

opening the water supply valve for a predetermined fill time less than that required to prime the circulation pump.

16. The method of claim 11, wherein determining that the rate of increase of the sump pressure exceeds the predetermined threshold rate comprises:

obtaining a first pressure reading;

obtaining a second pressure reading a predetermined amount of time after the first pressure reading; and determining that a difference between the first pressure reading and the second pressure reading exceeds a predetermined pressure difference.

17. The method of claim 16, wherein the predetermined pressure difference is measured in millimeters of water.

18. The method of claim 11, wherein determining that the rate of increase of the sump pressure exceeds the predetermined threshold rate comprises:

obtaining a sump pressure curve of the sump pressure over time;

determining a slope of the sump pressure curve; and determining that the slope of the sump pressure curve exceeds a predetermined slope.

19. The method of claim 11, further comprising:

regulating the water supply valve to stop the flow of water into the sump after determining that the circulation pump is primed; and operating the circulation pump to circulate water to one or more spray arm assemblies.

20. The method of claim 11, further comprising:

determining that the circulation pump is primed before operating the circulation pump during every wash cycle or rinse cycle.

* * * * *